US010010207B2

(12) United States Patent
Brown

(10) Patent No.: US 10,010,207 B2
(45) Date of Patent: Jul. 3, 2018

(54) LOCKING GARMENT HANGER

(71) Applicant: Myles Brown, Bladensburg, MD (US)

(72) Inventor: Myles Brown, Bladensburg, MD (US)

( * ) Notice: Subject to any disclaimer, the term of this patent is extended or adjusted under 35 U.S.C. 154(b) by 32 days.

(21) Appl. No.: 15/230,855

(22) Filed: Aug. 8, 2016

(65) Prior Publication Data

US 2018/0035834 A1 Feb. 8, 2018

(51) Int. Cl.
*A47G 25/20* (2006.01)
*A47G 25/48* (2006.01)

(52) U.S. Cl.
CPC ..... *A47G 25/20* (2013.01); *A47G 25/48* (2013.01)

(58) Field of Classification Search
CPC ..... A47G 25/20; A47G 25/48–25/50; A47G 25/481–25/488; A41D 27/22; E05B 69/00
See application file for complete search history.

(56) References Cited

U.S. PATENT DOCUMENTS 1,237,347 A * 8/1917 Lipoti ..... A47G 25/486 223/93
1,980,845 A * 11/1934 Beattie ..... D06F 71/22 223/52.1
3,184,127 A * 5/1965 Smith ..... D06F 59/02 223/67
4,669,642 A * 6/1987 Nicholas ..... A47G 25/14 211/118
5,360,148 A 11/1994 Goscin et al.
7,467,737 B1 12/2008 Bissett
7,748,581 B2 7/2010 Yamada

FOREIGN PATENT DOCUMENTS

FR 2332731 A * 7/1977
JP 2007125088 A * 5/2007

* cited by examiner

*Primary Examiner* — Ismael Izaguirre
(74) *Attorney, Agent, or Firm* — William Gray Mitchell

(57) ABSTRACT

The invention is a garment hanger with a collar clamping mechanism to secure a hung garment and prevent wrinkling of the collar and shoulder area thereof.

11 Claims, 2 Drawing Sheets

LOCKING GARMENT HANGER

CROSS REFERENCE TO RELATED APPLICATIONS

Not applicable.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

Field of the Invention

The invention is a garment hanger with a locking mechanism to minimize wrinkling in the collar and shoulder area of a garment, while creating structure and stability to improve the longevity of garment lines.

Background of the Invention

Garment hangers with features beyond mere hanging storage functionality are known in the field. For example, U.S. Pat. No. 7,467,737 to Bissett discloses a garment hanger for washing, drying and storing garments on the hanger, and includes neck and shoulder supporting components. The disclosed arrangement is primarily to facilitate the movement of air through the garment to facilitate the washing and drying of the garment while it remains on the hanger. The disclosure does not teach any clamping or other mechanism for securing the garment beyond the mechanism of a standard hanger.

U.S. Pat. No. 7,748,581 to Yamada is a garment hanger comprising a central collar support feature arranged between the hook and hanger body, designed as an integrated pair of curved pieces protruding rearward then folding over to retain a curve in the collar of the hung garment. Thus, the three-dimensional curve of a collar can be supported even when multiple garments are stacked, when the collar would otherwise be crushed. However, the disclosure does not teach any clamping or other mechanism for securing the garment in place.

Similar collar forms for integration with or attachment to garment hangers are described in U.S. Pat. No. 2,171,301, to Christensen, U.S. Pat. No. 2,468,477 to Zimmerman and U.S. Pat. No. 2,609,976 to Burk. In each case, the invention has a frame component for placement within the collar of a hung garment to support and maintain the curve of such collar, but none of the referenced documents includes any means of securing the garment or collar in place. As such, in any known garment hanger, the application of motion or pressure to the hanger or the garment itself risks moving or detaching the garment collar from its frame component, inevitably causing the collar to become subject to lateral or longitudinal forces that will pull or stretch the collar out of its intended shape.

The problem with known garment hangers is a lack of support combined with attachment for the upper portion of the garment, especially the collar, to the hanger. Thus, the aim of the present invention is to not only provide a framing component to preserve the ideal curvature of a garment collar, but to simultaneously secure the collar, and thereby the garment, to the hanger so that the garment will not become dislodged and the collar and/or garment itself become wrinkled or misshapen prior to wearing.

BRIEF SUMMARY OF THE INVENTION

In a preferred embodiment, 1 garment hanger comprising a hook component and hanger body, as well as a mechanism for securing a garment collar located between the hook component and hanger body, such mechanism comprising a forward collar frame and rear collar frame, each of a curved design, with the upper edges of each such collar frame being connected to a collar clamp which can be opened, closed and locked in a closed position to bring the two collar frames into contact, whereby the garment collar is inserted between the collar frames when such collar clamp is opened, then immovably secured between the collar frames when the collar clamp is closed.

In another preferred embodiment, the garment hanger as described herein, wherein the collar clamp comprises (1) a forward clamping wire, further comprising a forward locking member, a left hump, a left crimp, a right hump and a right crimp, and (2) rear clamping wire, further comprising a rear locking member, wherein the right crimp and the left crimp each encircle a portion of the rear clamping wire.

In another preferred embodiment, the garment hanger as described herein, wherein the hook component comprises a hook, a hook stem positioned underneath the rear locking member when the collar clamp is open and rearward to the rear locking member when the collar clamp is closed, and a hook component connector, which encircles the forward locking member.

In another preferred embodiment, the garment hanger as described herein, wherein pulling the hook in a forward and upward direction causes the hook stem to push the rear locking member towards forward locking member and the hook component connector to simultaneously pull the forward locking member towards rear locking member, locking the forward and rear locking members together upon full upward extension of the hook.

In another preferred embodiment, the garment hanger as described herein, wherein the hook component, collar clamp and hanger body are constructed of metal wire.

In another preferred embodiment, the garment hanger as described herein, wherein the gauge of the wire is between 1/16" and 1/4".

In another preferred embodiment, the garment hanger as described herein, wherein the garment hanger is constructed of plastic.

In another preferred embodiment, the garment hanger as described herein, wherein the forward collar frame and rear collar frame are each constructed of wood.

In another preferred embodiment, the garment hanger as described herein, wherein the two ends of forward clamping wire and the two ends of the rear clamping wire are attached to the upper edge of the forward collar frame and the rear collar frame, respectively, by inserting each wire end into a clamp mounting hole in the upper frame edge of the corresponding frame.

In another preferred embodiment, the garment hanger as described herein, wherein each wire end is affixed into its clamp mounting hole by an adhesive.

In another embodiment, a method of securing a garment collar and shoulders against wrinkling by hanging a garment on the garment hanger of claim 1, and locking the garment collar between the collar frames with the collar clamp.

DETAILED DESCRIPTION OF THE INVENTION

Figure 1:
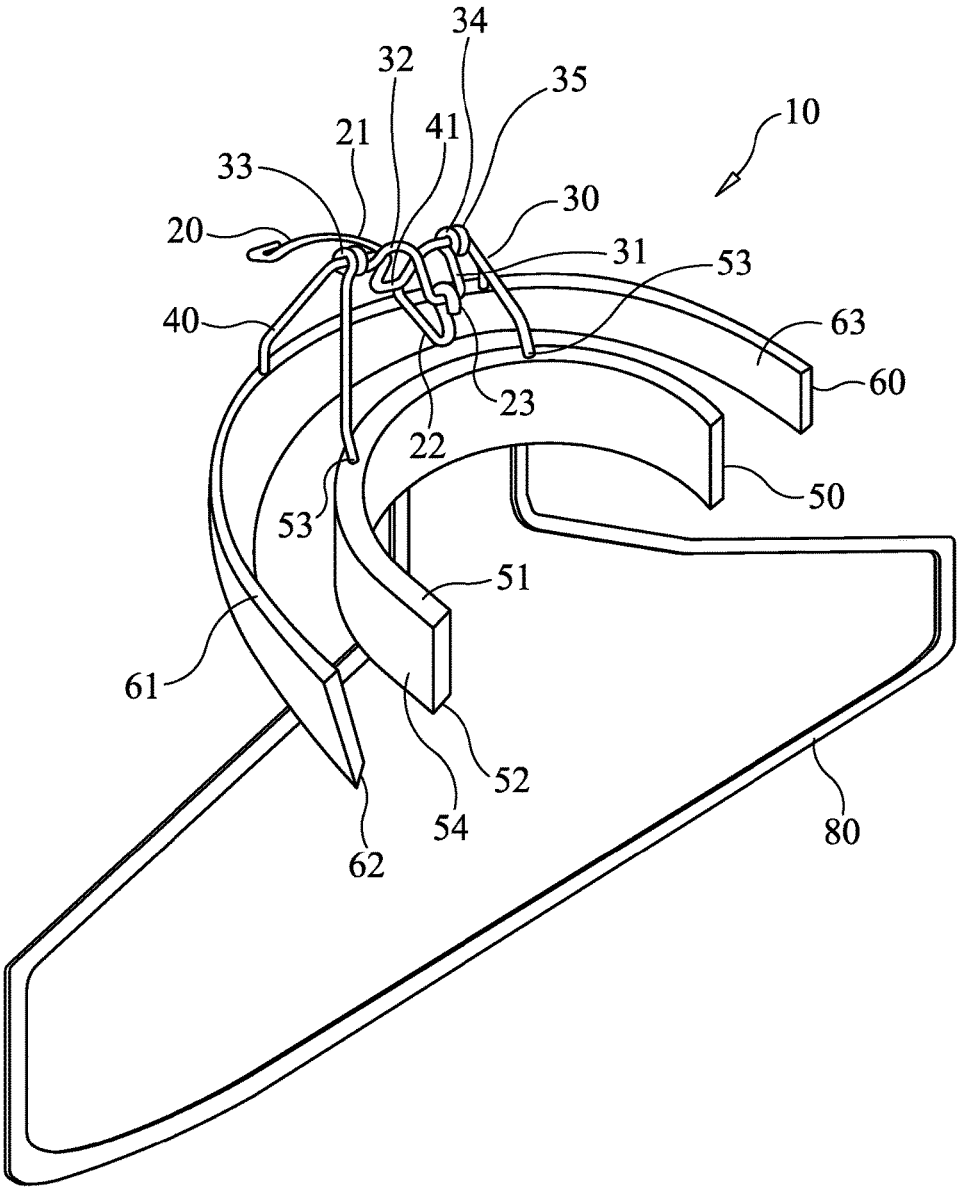
FIG. 1 is a line drawing evidencing a perspective view of a garment hanger with a collar clamp in an unlocked, open position.

The invention constitutes an addition to a traditional garment hanger, further comprising a component that will secure the collar so tightly that the garment will be enclosed in dry press, retain a wrinkle free shape, and prevent the collar of the hung garment from drooping and losing shape.

Structurally, the garment hanger of the invention comprises an upper section made up of a wire hook component 20, a lower section made up of a wire hanger body 80, with a central section made up of a combination of a wire collar clamp 70 and forward and rear collar frames 50 and 60, respectively. The central section is intended to comprise a dry press which can be lockably clamped to enclose a garment collar.

Since garment collars are curved, the collar frames 50 and 60 will also be curved, in a roughly semicircular configuration, to match the curves of a standard garment collar. For the purposes herein, the "front" or "forward" direction of the invention will be to the open side of this semicircle, with forward collar frame 50 ahead of rear collar frame 60. The "rear" or "rearward" direction will be to the closed side of the semicircle, with rear collar frame 60 ahead of forward collar frame 50. The terms "left" and "right" will be correspond to those designations when viewing the invention from the forward angle.

In a preferred embodiment, the wire of the various hanger components is uniform in gauge, with a preferred gauge of 1/16" to 1/4". More preferably, the wire gauge is approximately 1/8".

In another preferred embodiment, the wire of the hook 21 is flattened.

Alternatively, the gauge of wire may vary between the components. In either case, such wire will preferably be made of a metal or alloy known for use in heavy duty wire hangers, such as brass, bronze, steel, chrome, or any other appropriate commercial metal or alloy. Any component(s) of the garment hanger also may be fashioned of wood or plastic.

In a preferred embodiment, the hanger body will be connected to the lower edge 52 of the forward collar frame 50, and emanate downward therefrom to form two outwardly-flared appendages upon which the shoulders of a hung garment may rest. In one embodiment, the hanger body 80 will comprise two separate wire forms, each with a lower aspect angling towards the other, but with a gap in between. In an alternate embodiment, the hanger body 80 can be a single wire form, with a single, continuous lower aspect.

In another preferred embodiment, the forward and rear collar frames, 50 and 60, respectively, will be formed of curved, plate-like components, each in a roughly semicircular shape. The two frames will be sized so that the front frame 50 is slightly smaller than the rear frame 60, such that the front frame will fit into the curve of the rear frame when the clamping mechanism is closed, with the rear face of the front frame 54 contacting the front face of the rear frame 63 all along its surface. This form-fitting configuration of the two frames, when clamped together via the collar clamp 70, will serve to capture and immobilize the inserted collar of a garment.

Central to the invention design is collar clamp 70, which is comprised of interlocking forward clamp wire 30 and rear clamping wire 40 and can be opened and locked shut to hold the collar of an inserted garment in place between the two collar frames 50 and 60. Forward clamp wire 30 is attached to the upper edge 51 of the forward collar frame 50 by the insertion of each of at least two ends of forward clamping wire 30 into a clamp mounting holes 53. Similarly, rear clamp wire 40 is attached to the upper edge 61 of the rear collar frame 60 by the insertion of each of at least two ends of rear clamping wire 40 into a clamp mounting holes 64. Each such wire end is set in its corresponding mounting hole with a commercially known adhesive from the group comprising epoxies, urethanes, polyurethanes, polyimides, polyester resin, neoprene, elastomers, thermoplastics, thermosets, cyanoacrylate, acrylic polymers, or any other known commercial adhesive.

Forward clamping wire 30 is designed to project upward and slightly rearward, away from the upper edge 51 towards rear collar frame 60, thus to engage rear clamping wire 40. At its furthermost position from the upper edge 51, the forward clamping wire forms a left hump 32 and right hump 33, with a depressed forward locking member 31 located in between.

As detailed in the Detailed Description of the Figures, the hook component 20, forward clamping wire 30 and rear clamping wire 40 are configured such that the pulling of hook 21 in a forward and upward direction will push the rear clamping wire forward while simultaneously pulling the forward clamping wire back, thereby bringing the forward and rear collar frames into full contact. Such pulling of the hook component thereby locks forward and rear locking members 31 and 41 into contact between hook stem 22 and hook component connector 23. As such, when hook component 20 reaches a full upright position suitable for hanging hook 21 from a bar or hook, the collar clamp 70 will become locked in a closed position. Unlocking will only occur when the hook component is subsequently pulled in an opposite direction, i.e. rearward and downward, thus releasing the locking members.

Once a garment has been placed on the garment hanger and the collar of such garment locked into position between the collar frames, the collar and neck region of such garment will be protected from drooping or wrinkling, regardless of any movement or relocation of the assembly, until such time as the collar clamp is unlocked.

DETAILED DESCRIPTION OF THE FIGURES

FIG. 1 is a line drawing evidencing a perspective view of a garment hanger 10 with a collar clamp 70 (collectively, parts 30-41) attached to an upper edge 51 of a forward collar frame 50 and an upper edge 61 of a rear collar frame 60, with a hanger body 80 attached to the lower edge 52 of the forward collar frame.

Turning to the collar clamp 70, such mechanism is comprised of interlocking forward clamp wire 30 and rear clamping wire 40. Forward clamping wire 30 is attached to the upper edge 51 of the forward collar frame 50 by the insertion of each of at least two ends of forward clamping wire 30 into a clamp mounting hole 53. Each such end is set in its corresponding mounting hole with an adhesive or other known means of fixation. The collar clamp 70 is further attached to rear collar frame 60 by the attachment of a lower aspect 44 of a rear clamping wire 40 to the frame's upper edge 61, by an appropriate adhesive. Forward clamping wire 30 is designed to project upward and slightly rearward, away from the upper edge 51 towards rear collar frame 60, thus to engage rear clamping wire 40. At its furthermost position from the upper edge 51, the forward clamping wire forms a left hump 32 and right hump 33, with a depressed forward locking member 31 located in between.

Rear clamping wire 40 projects upward and slightly forward, away from upper edge 61 of rear collar frame 60 and towards the forward collar frame 50. At its furthermost point from upper edge 61, on either side of rear locking member 41, the rear clamping wire is encircled by the left crimp 33 and right crimp 35 of the forward clamping wire, respectively. The design whereby each crimp encircles a corresponding section of the rear clamping wire allows for a rotation of the rear and forward clamp wires relative to one another, thus bringing the rear and forward collar frames into contact.

Also pictured in FIG. 1 is hook component 20 which, as the mechanism is shown in an open, unlocked position, faces in a rearward direction. Hook component 20 comprises hook 21, hook stem 22, which is shown projecting across the underside of rear locking member 41, and a hook component connector 23, which encircles forward locking member 31 of the forward clamping wire 30. According to the arrangement of hook stem 22 under rear locking member 41, a pulling of hook 21 in a forward and upward direction will cause hook stem 22 to push the rear locking member 41 towards forward locking member 31, while hook component connector 23 simultaneously pulls forward locking member 31 towards rear locking member 41. When hook component 20 reaches a full upright position, the collar clamp 70 will thus lock in a closed position.

The open configuration of FIG. 1 allows for a shirt or similar collared garment to overlay the hanger body 80 at the region of the garment shoulders, while the curved collar extends upward in the space between forward collar frame 50 and rear collar frame 60.

Figure 2:
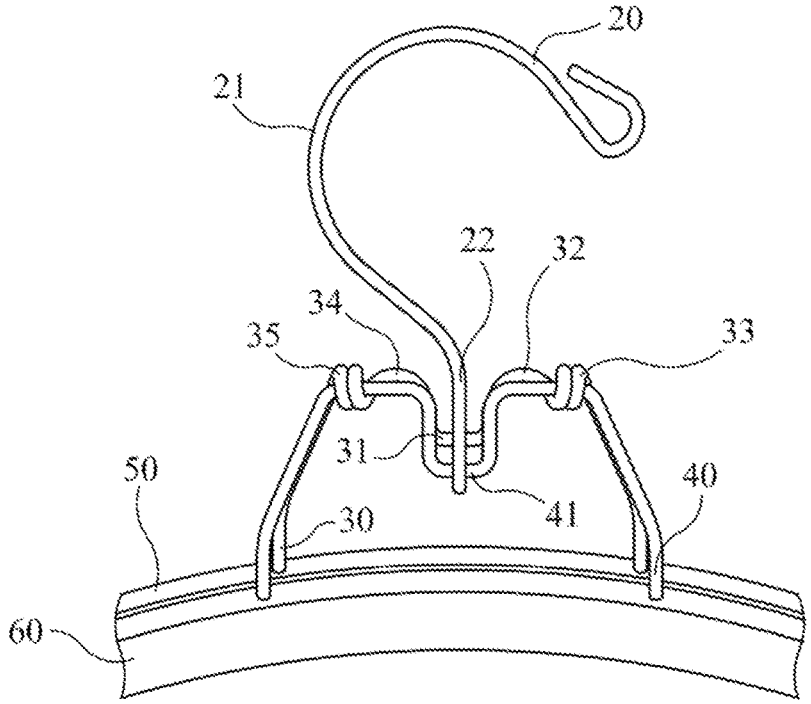
FIG. 2 is a line drawing evidencing a view from the front of the garment hanger of FIG. 1 with the collar clamp in a locked, closed position.

FIG. 2 is a line drawing evidencing a perspective view of the garment hanger of FIG. 1 with the collar clamp in a locked, closed position. In this configuration, hook component 20 is in an upright position and forward collar frame 50 and rear collar frame 60 are in contact at their respective rearward face 54 and forward face 63.

FIG. 2 shows the invention in a closed configuration, as viewed from the front. The closed configuration of FIG. 2 allows for the lockable closing of the forward collar frame 50 and the rearward collar frame 60 around the collar of the hung garment, maintaining the three-dimensional curved shape of the collar. The tension of the locking mechanism will thus hold the garment and collar immovable until such time as the garment hanger 10 is unlocked by pulling the hook component 20 in a downward and rearward motion, thus freeing the garment collar and allowing the garment to be removed.

Figure 3:
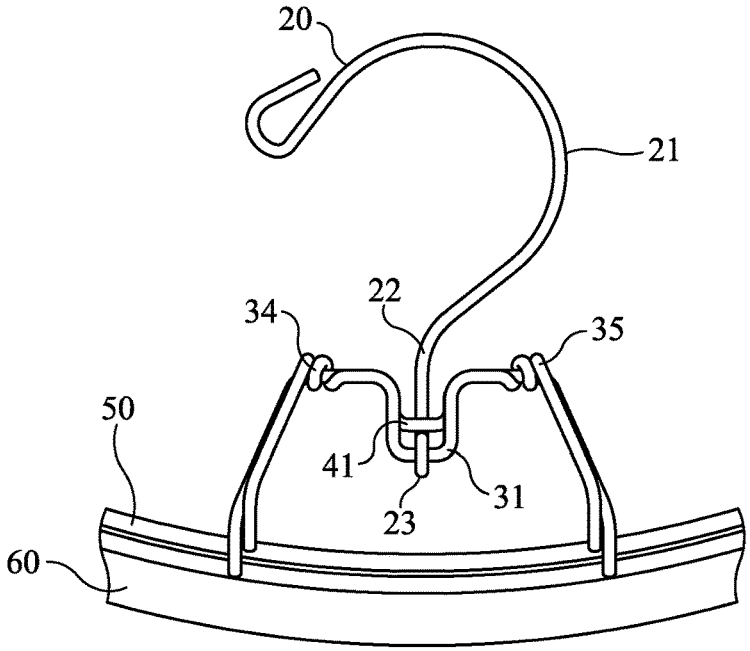
FIG. 3 is a line drawing evidencing a view from the rear of the closed, locked garment hanger of FIG. 2.

FIG. 3 again shows the closed configuration of FIG. 2, this time as viewed from the rear. In this alternative view, hook stem 22 projects behind rear locking member 41, while hook component connector 23 is shown encircling forward locking member 31.

LIST OF REFERENCE NUMBERS

10 garment hanger
20 hook component
21 hook
22 hook stem
23 hook component connector
30 forward clamping wire
31 forward locking member
32 left hump
33 left crimp
34 right hump
35 right crimp
40 rear clamping wire
41 rear locking member
50 forward collar frame
51 upper edge
52 lower edge
53 clamp mounting holes
54 rearward face of forward collar frame
60 rear collar frame
61 upper edge
62 lower edge
63 forward face of rear collar frame
64 clamp mounting holes
70 collar clamp (collectively, parts 30-41)
80 hanger body The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable equivalents.

I claim:

1. A garment hanger comprising a hook component and hanger body, as well as a mechanism for securing a garment collar located between the hook component and hanger body, such mechanism comprising a single forward collar frame and single rear collar frame, each of an approximately semicircular design, with the upper edges of each such collar frame being connected to a collar clamp which can be opened, closed and locked in a closed position upon full upward extension of the hook to bring the two collar frames into contact, whereby the garment collar is inserted between the collar frames when such collar clamp is opened, then immovably secured between the two collar frames when the collar clamp is closed.

2. The garment hanger of claim 1, wherein the collar clamp comprises (1) a forward clamping wire, further comprising a forward locking member, a left hump, a left crimp, a right hump and a right crimp, and (2) rear clamping wire, further comprising a rear locking member, wherein the right crimp and the left crimp each encircle a portion of the rear clamping wire.

3. The garment hanger of claim 2, wherein the hook component comprises a hook, a hook stem positioned underneath the rear locking member when the collar clamp is open and rearward to the rear locking member when the collar clamp is closed, and a hook component connector, which encircles the forward locking member.

4. The garment hanger of claim 3, wherein pulling the hook in a forward and upward direction causes the hook stem to push the rear locking member towards forward locking member and the hook component connector to simultaneously pull the forward locking member towards rear locking member, locking the forward and rear locking members together upon full upward extension of the hook.

5. The garment hanger of claim 1, wherein the hook component, collar clamp and hanger body are constructed of metal wire.

6. The garment hanger of claim 5, wherein the gauge of the wire is between 1/16" and 1/4".

7. The garment hanger of claim 1, wherein the garment hanger is constructed of plastic.

8. The garment hanger of claim 1, wherein the forward collar frame and rear collar frame are each constructed of wood.

9. The garment hanger of claim 1, wherein two ends of forward clamping wire and two ends of the rear clamping wire are attached to the upper edge of the forward collar frame and the rear collar frame, respectively, by inserting each such end into a corresponding clamp mounting hole in the upper frame edge of the corresponding frame.

10. The garment hanger of claim 9, wherein each end of the forward clamping wire and rear clamping wire is affixed into the corresponding clamp mounting hole by an adhesive.

11. A method of securing a garment collar and shoulders against wrinkling by hanging a garment on the garment hanger of claim 1, and locking the garment collar between the collar frames with the collar clamp.

* * * * *